US006167632B1

(12) United States Patent
Shor

(10) Patent No.: US 6,167,632 B1
(45) Date of Patent: Jan. 2, 2001

(54) DUAL CHALK LINE DEVICE

(76) Inventor: Ron Shor, 4523 W. 172nd St., Lawndale, CA (US) 90260

( * ) Notice: Under 35 U.S.C. 154(b), the term of this patent shall be extended for 0 days.

(21) Appl. No.: 09/276,109

(22) Filed: Mar. 25, 1999

(51) Int. Cl.[7] ..... B44D 3/38
(52) U.S. Cl. ..... 33/414; 33/413
(58) Field of Search ..... 33/414, 413, 756, 33/755; 242/395

(56) References Cited

U.S. PATENT DOCUMENTS 1,004,443 * 9/1911 Laut ..... 33/87
1,085,193 * 1/1914 Buniff .
2,589,500 * 3/1952 Landon et al. ..... 33/217
3,046,663 * 7/1962 Romero ..... 33/87
3,078,581 * 2/1963 Foster ..... 33/87
3,126,637 * 3/1964 Short ..... 33/87
3,206,855 * 9/1965 Fletcher ..... 33/87
3,311,319 * 3/1967 Campbell ..... 242/10
4,164,334 * 8/1979 Rathbun et al. ..... 242/405.3
4,565,011 * 1/1986 Karger ..... 33/414

* cited by examiner

*Primary Examiner*—Bernard Roskoski
*Assistant Examiner*—Maria Fernandez

(57) ABSTRACT

A dual chalk line device for marking straight lines in construction applications. The dual chalk line device includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

16 Claims, 2 Drawing Sheets

DUAL CHALK LINE DEVICE

BACKGROUND OF THE INVENTION

1. Field of the Invention

The present invention relates to chalk line boxes and more particularly pertains to a new dual chalk line device for marking straight lines in construction applications.

2. Description of the Prior Art

The use of chalk line boxes is known in the prior art. More specifically, chalk line boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,126,637; U.S. Pat. No. 2,589,500; U.S. Pat. No. 5,212,875; U.S. Pat. No. 5,063,681; U.S. Pat. No. 4,660,291; and U.S. Pat. No. Des. 339,044.

While these devices fulfill their respective, particular objectives and requirements, the aforementioned patents do not disclose a new dual chalk line device. The inventive device includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

In these respects, the dual chalk line device according to the present invention substantially departs from the conventional concepts and designs of the prior art, and in so doing provides an apparatus primarily developed for the purpose of marking straight lines in construction applications.

SUMMARY OF THE INVENTION

In view of the foregoing disadvantages inherent in the known types of chalk line boxes now present in the prior art, the present invention provides a new dual chalk line device construction wherein the same can be utilized for marking straight lines in construction applications.

The general purpose of the present invention, which will be described subsequently in greater detail, is to provide a new dual chalk line device apparatus and method which has many of the advantages of the chalk line boxes mentioned heretofore and many novel features that result in a new dual chalk line device which is not anticipated, rendered obvious, suggested, or even implied by any of the prior art chalk line boxes, either alone or in any combination thereof.

To attain this, the present invention generally comprises a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual chalk line device apparatus and method which has many of the advantages of the chalk line boxes mentioned heretofore and many novel features that result in a new dual chalk line device which is not anticipated, rendered obvious, suggested, or even implied by any of the prior art chalk line boxes, either alone or in any combination thereof.

It is another object of the present invention to provide a new dual chalk line device which may be easily and efficiently manufactured and marketed.

It is a further object of the present invention to provide a new dual chalk line device which is of a durable and reliable construction.

An even further object of the present invention is to provide a new dual chalk line device which is susceptible of a low cost of manufacture with regard to both materials and labor, and which accordingly is then susceptible of low prices of sale to the consuming public, thereby making such dual chalk line device economically available to the buying public.

Still yet another object of the present invention is to provide a new dual chalk line device which provides in the apparatuses and methods of the prior art some of the advantages thereof, while simultaneously overcoming some of the disadvantages normally associated therewith.

Still another object of the present invention is to provide a new dual chalk line device for marking straight lines in construction applications.

Yet another object of the present invention is to provide a new dual chalk line device which includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

Still yet another object of the present invention is to provide a new dual chalk line device that features two different colors of chalk in the separate chambers. This permits a user to redo a bad snap by using the other color. This is particularly useful when the two lines are very close together.

Even still another object of the present invention is to provide a new dual chalk line device that eliminates the need to carry two chalk line boxes, one with a plumb bob to do vertical lines, and another with a hook to do diagonal lines. Rather, a hook may be attached to one line and a plumb bob to the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
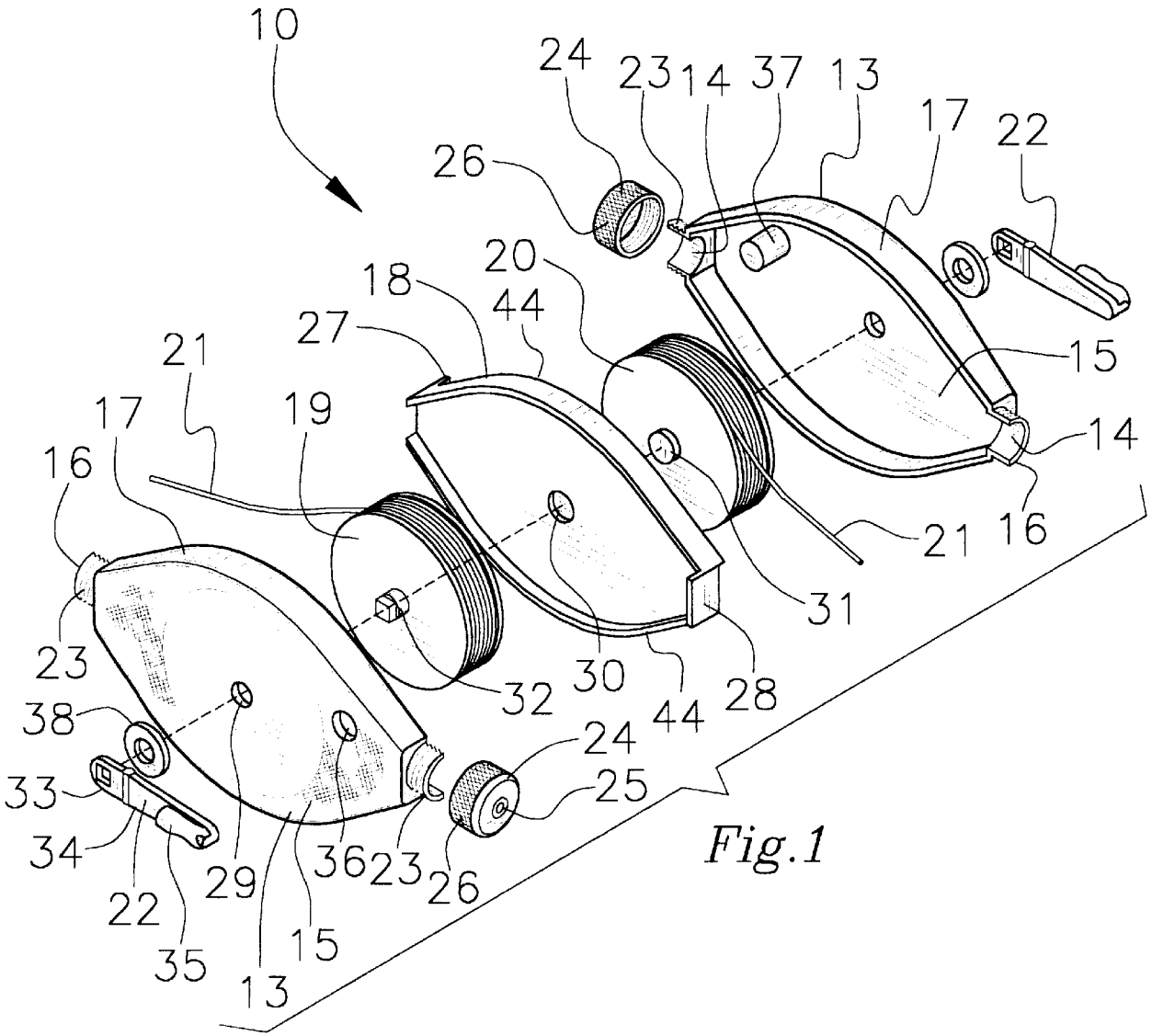
FIG. 1 is a schematic perspective exploded view of a new dual chalk line device according to the present invention.
Figure 2:
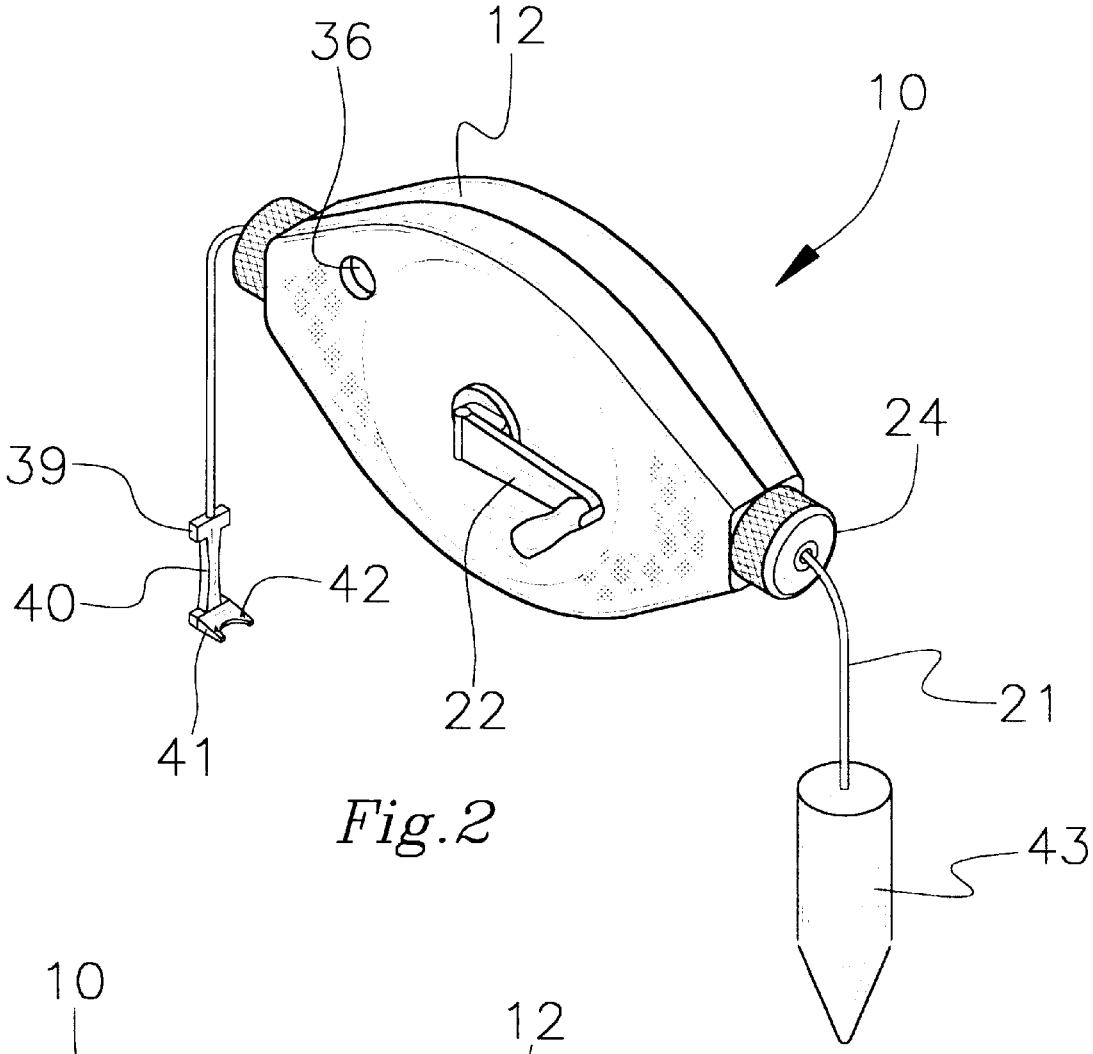
FIG. 2 is a schematic perspective view of the present invention .
Figure 3:
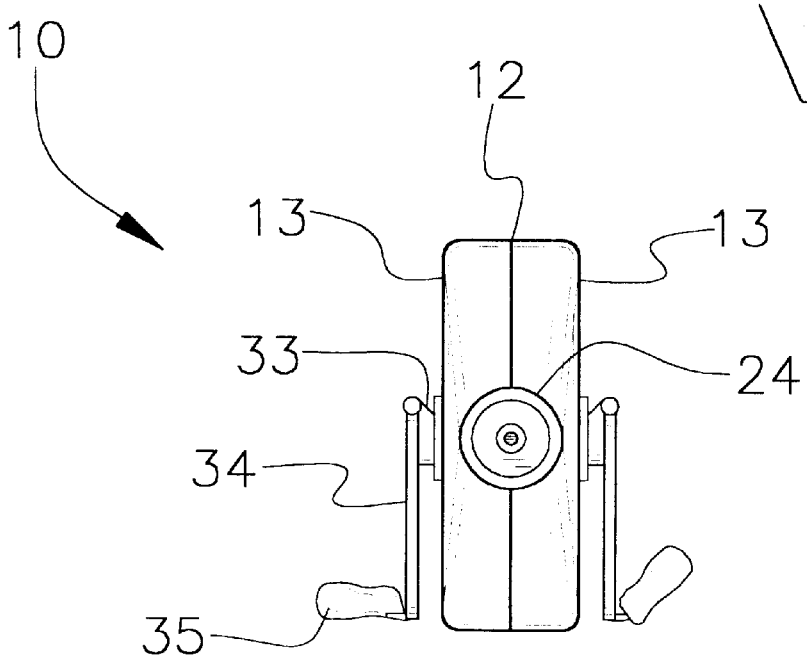
FIG. 3 is a schematic side view of the present invention.

With reference now to the drawings, and in particular to FIGS. 1 through 3 thereof, a new dual chalk line device embodying the principles and concepts of the present invention and generally designated by the reference numeral 10 will be described.

As best illustrated in FIGS. 1 through 3, the dual chalk line device 10 generally comprises a housing 12 with a pair of separable sections 13 and a pair of openings 14. Each of the sections has a sidewall 15, a pair of opposite ends 16, and a pair of side edges 17 extending between the ends. A divider panel 18 is positioned between the sections of the housing to separate the housing into a pair of compartments. A first spool 19 is rotatably disposed in one of the compartments of the housing. A second spool 20 is rotatably disposed in another of the compartments of the housing. Each of the spools has a quantity of line 21 wrapped therearound. A pair of handles 22 are mounted to the spools and positioned outside the housing. The handles permit external rotation of the spools.

Preferably, the pair of side edges of the sections taper together towards the ends such that each of the sections has a generally oblong football-like shape.

Also preferably, each of the ends of each of the sections has an externally threaded semicircular portion 23 extending from it. The semicircular portions of one of the sections engage the semicircular portions of another of the sections to form a pair of openings into the housing. In such an embodiment, a pair of endcaps 24 are threadedly coupled to the openings of the housing. The endcaps couple the sections of the housing together. Each of the endcaps has an eyelet 25 extending through it through which the line extends. Optionally, each of the endcaps may have alternating diagonal scoring 26 therearound for frictionally enhancing the grip of a user when removing the endcaps.

Preferably, the divider panel forms a seal with the housing for helping prevent materials such as chalk from traveling between the compartments. Ideally, a peripheral flange 44 extends around the outer periphery of the divider panel to form a seal with the housing to better prevent chalk from escaping from the housing and intermingling from one compartment to another. The peripheral flange should be oriented perpendicular to the divider panel and extend out past both faces of the divider panel.

Also preferably, the divider panel has a first flange 27 extending from an end of the divider panel in a first direction for closing one of the openings off from one of the compartments. The divider panel also has a second flange 28 extending from another end of the divider panel in a second direction for closing another of the openings off from another of the compartments.

Each of the spools has a quantity of line wrapped around it. The line of one of the spools is slidably extendible out of one of the openings of the housing and through the eyelet of one of the endcaps. The line of another of the spools is slidably extendible out of another of the openings of the housing and through the eyelet of the other endcap.

Preferably, each of the sections of the housing has a central aperture 29 through its sidewall. Each of the spools also has a crankshaft 32. The crankshafts extend through the central apertures of the sections of the housings. The divider panel also has opposed central cavities 30 extending towards each other. Each of the spools has an inner protuberance 31 that is rotatably inserted in an associated central cavity of said divider panel. The inner protuberances should be bulbous so that they snap into the central cavities.

Preferably, the pair of handles are mounted to the crankshafts of the spools. The handles permit external rotation of the spools. In one embodiment, each of the handles has a hinge portion 33 that is coupled to a crankshaft, an arm portion 34 pivotally coupled to the hinge portion, and a grasping portion 35 rotatably coupled to the arm portion.

In such an embodiment, each of the sidewalls of the sections of the housing has a handle receiving aperture 36 extending therein and a tubular casing 37 extending into the housing from the handle receiving aperture. The casings are adapted for preventing chalk dust from contacting the grasping portions when inserted in the handle receiving apertures.

The hinge portion permits pivoting of the arm portion between a deployed position and a retracted position. The grasping portion is outwardly extendable when the arm portion is in a deployed position. The grasping portion is inserted in the handle receiving aperture of the housing when the arm portion is in a retracted position.

In a second embodiment, or in combination with the first embodiment, each of the grasping portions is pivotable between a folded position and an unfolded position. As shown in FIG. 1, each of the grasping portions is aligned generally parallel the respective arm portion when in the folded position. As shown in FIGS. 2 and 3, each of the grasping portions is aligned generally perpendicular the respective arm portion when in the unfolded position.

A pair of washers 38 may extend around the crankshafts of the spools between the handles and the housing for helping prevent wear on the housing.

As seen in FIG. 2, a hook 39 may be coupled to a free end of the line of one of the spools. In such an embodiment, the hook has an I-shaped portion 40 coupled to the line and a U-shaped portion 41 extending perpendicularly from an outer end of the I-shaped portion and adapted for hooking onto corners of building materials. Ideally, the U-shaped portion has a pair of teeth 42 extending from it that are adapted for biting into the corners of building materials to prevent the hook from slipping off of the corners.

Optionally, a plumb bob 43 may be coupled to a free end of the line of another of the spools. Having both a hook and a plumb bob on the device reduces the quantity of tools a user needs to carry with him or her as the device functions as two separate tools.

Preferably, a quantity of chalk powder of a first color is disposed in one of the compartments of the housing. A quantity of chalk powder of a unique second color is disposed in another of the compartments of the housing.

The preferred length of the device between its opposite ends (including the endcaps) is between about 4 and 6 inches, ideally about 5½ inches. The preferred width of the device between the sidewalls of the sections of the housing (not including the handles) is between about 1½ and 2 inches, ideally about 1¾ inches.

In use, the line from one of the spools is extended from the housing and stretched tight between two points. The line is then pulled and released so that it "snaps" against a surface, leaving a line of chalk dust. When finished using, the handle is rotated to reel in the line.

Because the two lines are completely independent of each other, users would be able to continue their work if one of the chalk lines was severed or was caught in the housing, or if one compartment ran low on chalk dust.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk line device, comprising:

a housing having a pair of separable sections and a pair of openings;

each of said sections having a sidewall, a pair of opposite ends, and a pair of side edges extending between said ends;

a divider panel being positioned between said sections of said housing and separating said housing into a pair of compartments;

a first spool being rotatably disposed in one of said compartments of said housing;

a second spool being rotatably disposed in another of said compartments of said housing;

each of said spools having a quantity of line wrapped therearound; and a pair of handles being mounted to said spools and positioned outside said housing, said handles being for permitting external rotation of said spools;

wherein each of said ends of each of said sections has a semicircular portion extending therefrom, said semicircular portions of one of said sections engaging said semicircular portions of another of said sections to form said pair of openings of said housing.

2. The chalk line device of claim 1, wherein each of said semicircular portions is externally threaded, and additionally comprising a pair of endcaps being threadedly coupled to said openings of said housing, said endcaps coupling said sections of said housing together.

3. The chalk line device of claim 1, wherein said divider panel forms a seal with said housing for helping prevent materials from traveling between said compartments.

4. The chalk line device of claim 1, wherein said divider panel has a first flange extending from an end of said divider panel in a first direction for closing one of said openings off from one of said compartments, said divider panel having a second flange extending from another end of said divider panel in a second direction for closing another of said openings off from another of said compartments.

5. The chalk line device of claim 1, wherein said divider panel has opposed central cavities extending towards each other, each of said spools having an inner protuberance being rotatably inserted in said central cavities of said divider panel.

6. The chalk line device of claim 1, wherein each of said sections of said housing has a central aperture through said sidewall thereof, each of said spools having a crankshaft, said crankshafts extending through said central apertures of said sections of said housings, said handles being mounted to said crankshafts of said spools.

7. The chalk line device of claim 6, wherein each of said handles has a hinge portion being coupled to said crankshaft, an arm portion pivotally coupled to said hinge portion, and a grasping portion rotatably coupled to said arm portion.

8. The chalk line device of claim 7, wherein each of said sidewalls of said sections of said housing has a handle receiving aperture extending therein and a tubular casing extending into said housing from said handle receiving aperture, said handle receiving apertures being adapted for receiving said grasping portions, said casings being adapted for preventing chalk from contacting said grasping portions when inserted in said handle receiving apertures.

9. The chalk line device of claim 1, wherein each of said handles has a grasping portions being pivotable between a folded position and an unfolded position, each of said grasping portions being aligned generally parallel the respective arm portion when in said folded position, each of said grasping portions being aligned generally perpendicular the respective arm portion when in said unfolded position.

10. The chalk line device of claim 1, further comprising a hook coupled to a free end of said line of one of said spools and adapted for hooking onto building materials.

11. The chalk line device of claim 10, wherein said hook has an I-shaped portion coupled to said line and a U-shaped portion extending perpendicularly from an outer end of said I-shaped portion adapted for hooking onto corners of building materials.

12. The chalk line device of claim 11, wherein said U-shaped portion has a pair of teeth extending therefrom and adapted for biting into said corners of building materials for helping prevent said hook from slipping off of said corners.

13. The chalk line device of claim 1, further comprising a plumb bob being coupled to a free end of said line of one of said spools.

14. The chalk line device of claim 1, further comprising a quantity of chalk powder having a first color being disposed in one of said compartments of said housing.

15. The chalk line device of claim 14, further comprising a quantity of chalk powder having a unique second color being disposed in another of said compartments of said housing.

16. A chalk line device, comprising:

a housing having a pair of separable sections;

each of said sections having a sidewall, a pair of opposite ends, and a pair of side edges extending between said ends and tapering together towards said ends such that each of said sections has a generally oblong shape;

each of said ends of each of said sections having an externally threaded semicircular portion extending therefrom, said semicircular portions of one of said sections engaging said semicircular portions of another of said sections to form a pair of openings into said housing;

each of said sections having a central aperture through said sidewall thereof;

a pair of endcaps being threadedly coupled to said openings of said housing, said endcaps coupling said sections of said housing together;

each of said endcaps having an eyelet extending therethrough;

a divider panel being positioned between said sections of said housing and separating said housing into a pair of compartments;

said divider panel forming a seal with said housing for helping prevent materials from traveling between said compartments;

wherein said divider panel has opposed central cavities extending therein towards each other;

said divider panel having a first flange extending from an end of said divider panel in a first direction for closing one of said openings off from one of said compartments, said divider panel having a second flange extending from another end of said divider panel in a second direction for closing another of said openings off from another of said compartments;

a first spool being rotatably disposed in one of said compartments of said housing;

a second spool being rotatably disposed in another of said compartments of said housing;

each of said spools having a quantity of line wrapped therearound, said line of one of said spools being slidably extendible out of one of said openings of said housing, said line of another of said spools being slidably extendible out of another of said openings of said housing;

each of said spools having an inner protuberance being rotatably inserted in said central cavities of said divider panel, each of said spools having a crankshaft, said crankshafts extending through said central apertures of said sections of said housings;

a pair of handles being mounted to said crankshafts of said spools, said handles being for permitting external rotation of said spools;

each of said handles having a hinge portion being coupled to said crankshaft, an arm portion pivotally coupled to said hinge portion, and a grasping portion rotatably coupled to said arm portion;

each of said sidewalls of said sections of said housing having a handle receiving aperture extending therein and a tubular casing extending into said housing from said handle receiving aperture, said casings being adapted for preventing chalk from contacting said grasping portions when inserted in said handle receiving apertures;

said hinge portion permitting pivoting of said arm portion between a deployed position and a retracted position, said grasping portion being outwardly extendable when said arm portion is in a deployed position, said grasping portion being inserted in said handle receiving aperture of said housing when said arm portion is in a retracted position;

each of said grasping portions being pivotable between a folded position and an unfolded position, each of said grasping portions being aligned generally parallel the respective arm portion when in said folded position, each of said grasping portions being aligned generally perpendicular the respective arm portion when in said unfolded position;

a pair of washers extending around said crankshafts of said spools between said handles and said housing for helping prevent wear on said housing;

a hook being coupled to a free end of said line of one of said spools;

said hook having an I-shaped portion coupled to said line and a U-shaped portion extending perpendicularly from an outer end of said I-shaped portion adapted for hooking onto corners of building materials;

said U-shaped portion having a pair of teeth extending therefrom and adapted for biting into said corners of building materials for helping prevent said hook from slipping off of said corners;

a plumb bob being coupled to a free end of said line of another of said spools;

a quantity of chalk powder having a first color being disposed in one of said compartments of said housing; and a quantity of chalk powder having a unique second color being disposed in another of said compartments of said housing.

* * * * *